United States Patent [19]

Berger

[11] 4,088,988

[45] * May 9, 1978

[54] PERSONNEL CABLE TRANSPORT SAFETY SYSTEM

[76] Inventor: Philip H. Berger, 2250 Pheasant Way, Salt Lake City, Utah 84121

[ * ] Notice: The portion of the term of this patent subsequent to Nov. 9, 1993, has been disclaimed.

[21] Appl. No.: 694,594

[22] Filed: Jun. 10, 1976

Related U.S. Application Data

[63] Continuation-in-part of Ser. No. 589,570, Jun. 23, 1975, Pat. No. 3,991,413.

[51] Int. Cl.[2] ..... G08B 21/00

[52] U.S. Cl. ..... 340/267 R; 323/1; 340/248 A; 340/409; 340/421

[58] Field of Search ..... 323/1, 4; 340/267 R, 340/421, 220, 419, 248 A, 248 B, 248 C, 409, 213 R, 282, 310 R, 416; 179/2 A, 2 C, 2 R, 1 PC

[56] References Cited

U.S. PATENT DOCUMENTS

| | | | |
|---|---|---|---|
| 3,657,695 | 4/1972 | Birmingham | 340/282 |
| 3,784,844 | 1/1974 | McGrogan, Jr. | 323/1 |
| 3,896,427 | 7/1975 | Campman | 340/282 |
| 3,991,413 | 11/1976 | Berger | 340/421 |

*Primary Examiner*—Glen R. Swann, III
*Attorney, Agent, or Firm*—Trask & Britt

[57] ABSTRACT

A constant current generator supplies a constant current signal to a plurality of detectors and a reference resistance connected to an output line and a ground line. Each detector includes a reference resistor connected in series in the output line, and a sensor connected between the output and ground. Upon the incidence of an external stimulus, the sensor becomes conductive shunting out all resistance subsequent in circuit and causing a predictable voltage change at the output of the constant current generator. A trigger senses the voltage change and sends signals to cause operational signals to be sent as desired, for example, to shut down a personnel cable transport system (e.g., ski chair lift) and indicate the location of the external stimulus. A detector may be bypassed by placing a permanent magnet on or into its chassis. The constant current generator output is unaffected by changes in temperature.

24 Claims, 8 Drawing Figures

DETECTION CIRCUIT
320
SENSOR TRIGGER
540
544
2N5465
546
MJE243
IN4003
548
20M
220
10K
1M
OPENLINE TRIGGER
542
2N5465
560
562
MJE 243
IN4003
564
20 M
1M
220
10K
728
726
724
314
720
722
502
CURRENT REGULATOR
506
MJE 243
514
522
512
MJE 243
524
526
516
518
22.1 K
3.01 K
10K
825
1K
314
200
304

IN4001
.001µf
716
712
316
710
CONSTANT CURRENT GENERATOR
510
MJE 243
6.8 K
520
72723
.001 µf
3.21 K
10K
56.2 K
VOLTAGE REGULATOR
220
40µf
3.01 K
IN4753A
304
300
POWER SUPPLY
1K
506
BIAS CIRCUIT
IN4735
10µf
10K
IN4003
708
706
704
702
700
RECTIFIER
500
306
IN4003
IN4003
4.7
502
AC IN 1/4 ASB
TRANS FORMER
504

PERSONNEL CABLE TRANSPORT SAFETY SYSTEM

RELATED APPLICATIONS

This application is a continuation-in-part of U.S. Pat. application Ser. No. 589,570, filed June 23, 1975, which matured into U.S. Pat. No. 3,991,413. The disclosure of that application and patent is incorporated herein by reference as if fully set forth herein.

BACKGROUND OF THE INVENTION

1. Field

This invention relates to constant current detector systems and constant current generators. In particular, this invention provides for a system having bypassable detectors which detect an external stimulus by causing a predictable voltage change at the output of a constant current generator. More specifically, it provides a system to detect personnel cable transport system malfunctions and stop the personnel cable transport system upon the occurrence of a malfunction.

2. State of the Art

Known detector systems typically employ voltage sources and rely on electrical circuit parameter variances (e.g. current) in detecting circuitry. These systems are limited to environments in which the ambient temperature is relatively constant absent the use of costly components and/or more components to adapt them to a wide range temperature environment.

For example, the ambient temperature environment for a safety detector system used with a personnel cable transport system (e.g., ski chair lift, aerial tram, gondola, and the like) typically found at ski recreation areas may vary from well below 0° Fahrenheit to temperatures well above freezing (e.g., 40° to 60° Fahrenheit). Indeed, some personnel cable transport systems are even operated in the summer when ambient temperatures frequently exceed 80° Fahrenheit. Detector systems heretofore known are not readily or economically adaptable to such an environment or are not fully capable to monitor all desirable safety aspects. Accordingly, a detector system which is workable for all safety aspects in a wide temperature range environment is desirable.

Other known systems which may be regarded as comprised of a string of (detector) switches are not necessarily affected by ambient temperature. However, such systems are undesirable because they are very difficult to troubleshoot in the event of a failure. Further, such systems are very susceptible to lightening damage. That is, stray voltages may be generated by the lightening in the wiring between towers. Those voltages can damage the system detector switches because they may be of sufficient magnitude to weld or vaporize switch contacts.

Yet other known systems of the type which are comprised of a string of switches (in series) may have a resistor associated with each (detector) switch which is electrically included in a bridge circuit or its equivalent when its (detector) switch detects (operates). Balance networks may then be used to locate the operating switch. However, such systems are typically incapable of handling two or more malfunctions.

It may also be noted that detector systems heretofore known employ detectors or detecting circuitry in cooperation with a centralized unit to receive and process detection signals. The failure of any one or more of such detectors may, in some cases, render the entire system inoperative. In other cases, the detector may generate a detection signal because of an intermittent environmental condition. In such circumstances, it may be desirable to bypass the concerned detector. Further, it may also be desirable to keep track of which detectors are bypassed.

In some cases, detectors may be located at some substantial distance from each other and from a centralized unit to receive and process detection signals. To properly test and align and to effectively maintain such a system, communication between a technician at the centralized unit and at one or more detectors may be required. Systems heretofore known do not provide for such communication.

SUMMARY OF THE INVENTION

A detection system includes a constant current generator which receives power from a power supply and which supplies a constant current signal to a plurality of detectors via an output supply line and a ground return line. The detectors each include a detector electrical resistance in series in the output line, sensor means connected between the output and ground lines, bypass means to bypass the sensor means and means to indicate that a sensor is bypassed. A reference resistance is connected between the output and ground return line. A detector circuit is connected to the output of the constant current generator to detect the voltage thereat and send a detection signal to operation means. The voltage detected is predictable and reflects the total electrical resistance in the circuit of the output and ground return line. Upon the incidence of an external stimulus, the sensor means changes from a non-conductive to a conductive state changing the total resistance in circuit and the value of the predictable voltage at the output of the constant current generator. Bypass means is included in each detector to electrically bypass the sensor and indicate such. Preferably the bypass means is comprised of a magnetically controlled switch operable by a portable magnet which may be positioned proximate the switch on the chassis of the detector to operate the switch.

The constant current generator is preferably insensitive to temperature changes and is comprised of a voltage regulator and current regulator. The current regulator includes a first transistor having a base connected to ground through a dropping resistor. Its emitter is also connected to ground through a dropping resistor. The base of a second transistor is connected through a biasing resistance to the collector of the first transistor and to the output of the voltage regulator via another biasing resistance. The collector of the second transistor is connected as the output of the constant current generator; and the emitter of the second transistor is connected to the base of the first transistor.

In another embodiment, a plurality of adapters are connected to the output and ground lines preferably proximate each detector and the constant current generator to adapt to removable communication means which is preferably a telephone handset.

In yet another embodiment, the detector circuit includes an open circuit detector to detect an open circuit and a sensor detector to detect sensor operation. Preferably, the detector system includes open circuit locate means to detect the location of an open circuit condition. Preferably, the operation means includes indicator means to indicate the identity of an operating sensor means and the location of an open circuit condition.

The operation means may also include reset means to reactivate the detector system subsequent to the generation of a detection signal, and manual bypass means to electrically bypass all detection signals.

In yet another embodiment, the detectors are each positioned proximate the cable and cable wheels on the towers of a personnel cable transport system.

BRIEF DESCRIPTION OF THE DRAWINGS

In the drawings, which illustrate the best mode presently contemplated for carrying out the invention.

DESCRIPTION OF THE ILLUSTRATED EMBODIMENT

Figure 1:
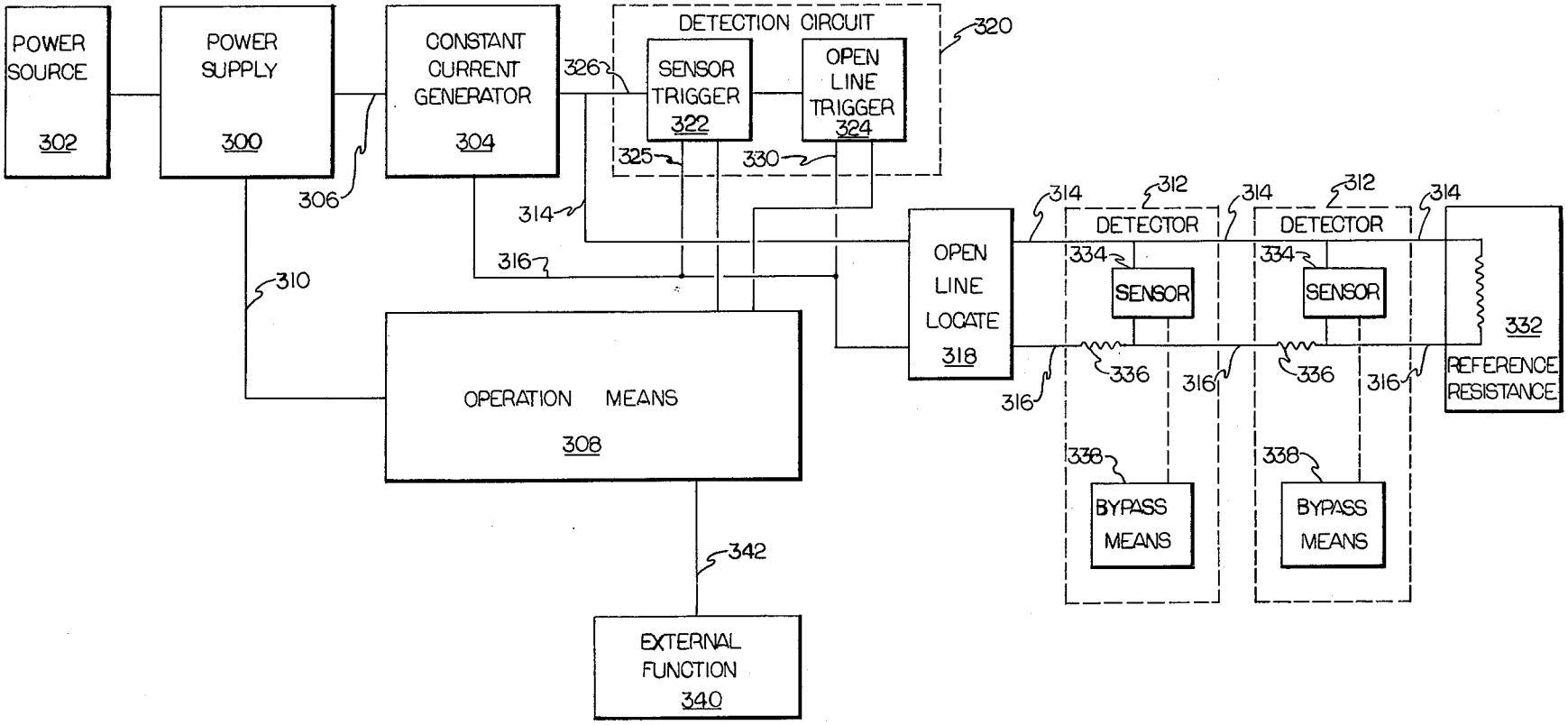
FIG. 1 is a simplified block diagram of a detector system of the invention.

The detector system of FIG. 1 has a power supply 300 which receives power from an external source 302. The power supply delivers power to the constant current generator 304 via conductor 306 and to the operation means 308 via conductor 310. The constant current generator 304 supplies a constant current signal to a plurality of detectors 312 via an output supply line 314 and ground return line 316 through the open line locate circuit 318. The detection circuit 320, which is comprised of the sensor trigger 322 and open line trigger 324, is connected across the output of the constant current generator 304 by conductors 325, 326 and 330. The output supply line 314 and ground return line 316 are also connected to a reference resistance 332 preferably subsequent in electrical circuit to the detectors 312.

The detectors 312 include sensor means 334, a detector reference resistance 336 and bypass means 338. The sensor 334 becomes conductive upon the incidence of a selected external stimulus shunting out all resistance subsequent in the electrical circuit and causing a predictable change in the voltage at the output of the constant current generator 304. Similarly, upon the occurrence of an open line (open circuit) in the output and ground line 316, 314 circuit, the predictable voltage change will occur at the output of the constant current generator 304. The detector circuit 320 senses the predictable changes in voltage and supplies detection signals to the operation means 308 which in turn processes the detection signals into operation signals which are sent to external functions 340 via conductor 342.

Figure 2:
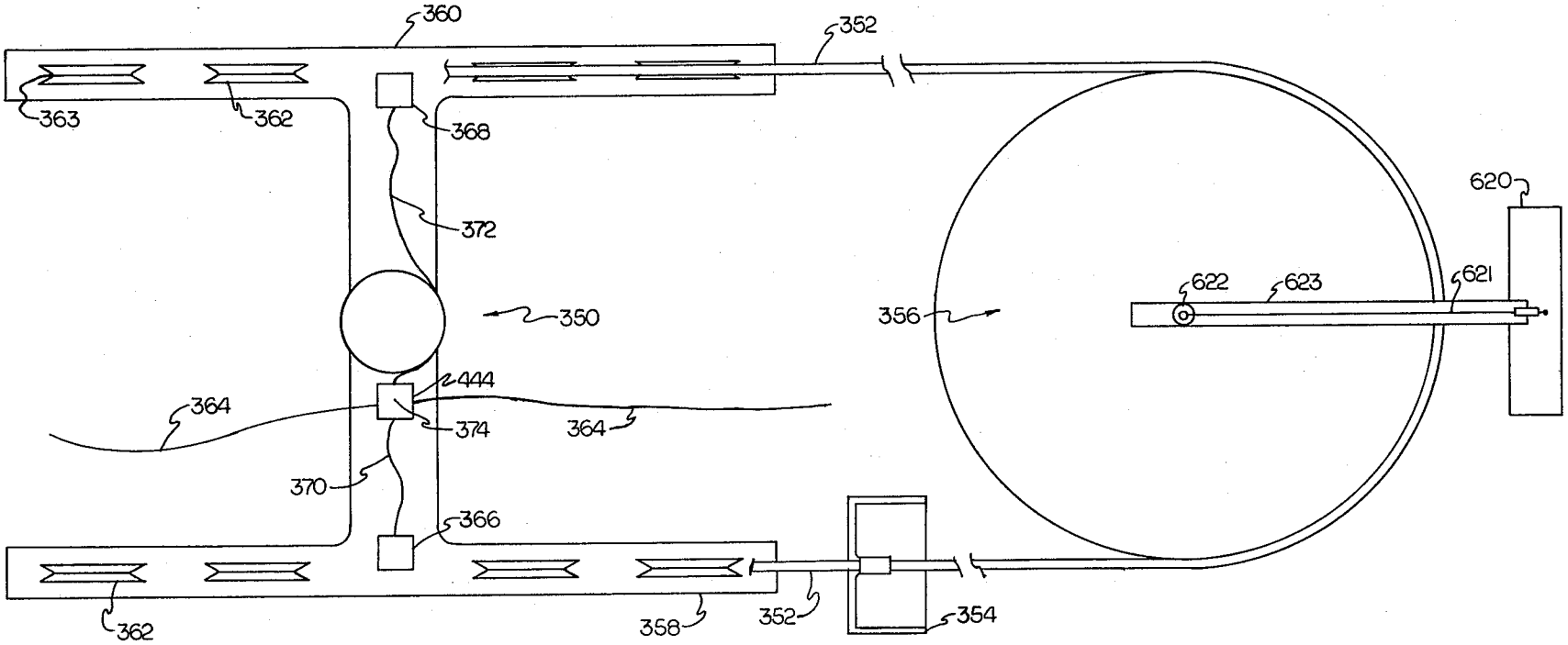
FIG. 2 is a partial top view of a chair lift system.

It should be noted that the system illustrated in FIG. 1 is particularly adaptable for use with personnel cable transport systems such as ski chair lifts, gondolas, aerial trams and other surface lifts. FIG. 2 depicts a partial top view of a typical chair lift system which has a plurality of towers 350, a cable 352, a plurality of chairs 354 spaced along the cable 352, and wheels 356 at opposite ends (only one shown). The towers 350 typically have opposite arms 358 and 360 that have grooved rotatable wheels 362 adapted thereto. The wheels 362 support and guide the cable 352. In operation, circumstances may occur to cause the cable 352 to jump out of the grooves 363 of the wheels 362 (i.e., derope). In that event, continued operation would pose a threat to the chair lift system and to persons in the chairs 354. Accordingly, it is desirable that chair lift system (i.e., personnel cable transport system) operation be terminated as soon as possible to minimize the hazard to the chair occupants and the equipment. The detector system of the instant invention is provided to, inter alia, rapidly and reliably cause termination of chair lift system (i.e., personnel cable transport system) operation in the event of deroping. As shown in FIG. 2, a two conductor insulated cable 364 acts as the output supply line 316 and ground return line 314. The detector means is illustrated as a first sensor 366 and a second sensor 368, respectively, conductively connected by conductors 370 and 372 to a tower module 374 which contains associated circuitry as hereinafter set forth.

Figures 3, 4, 5:
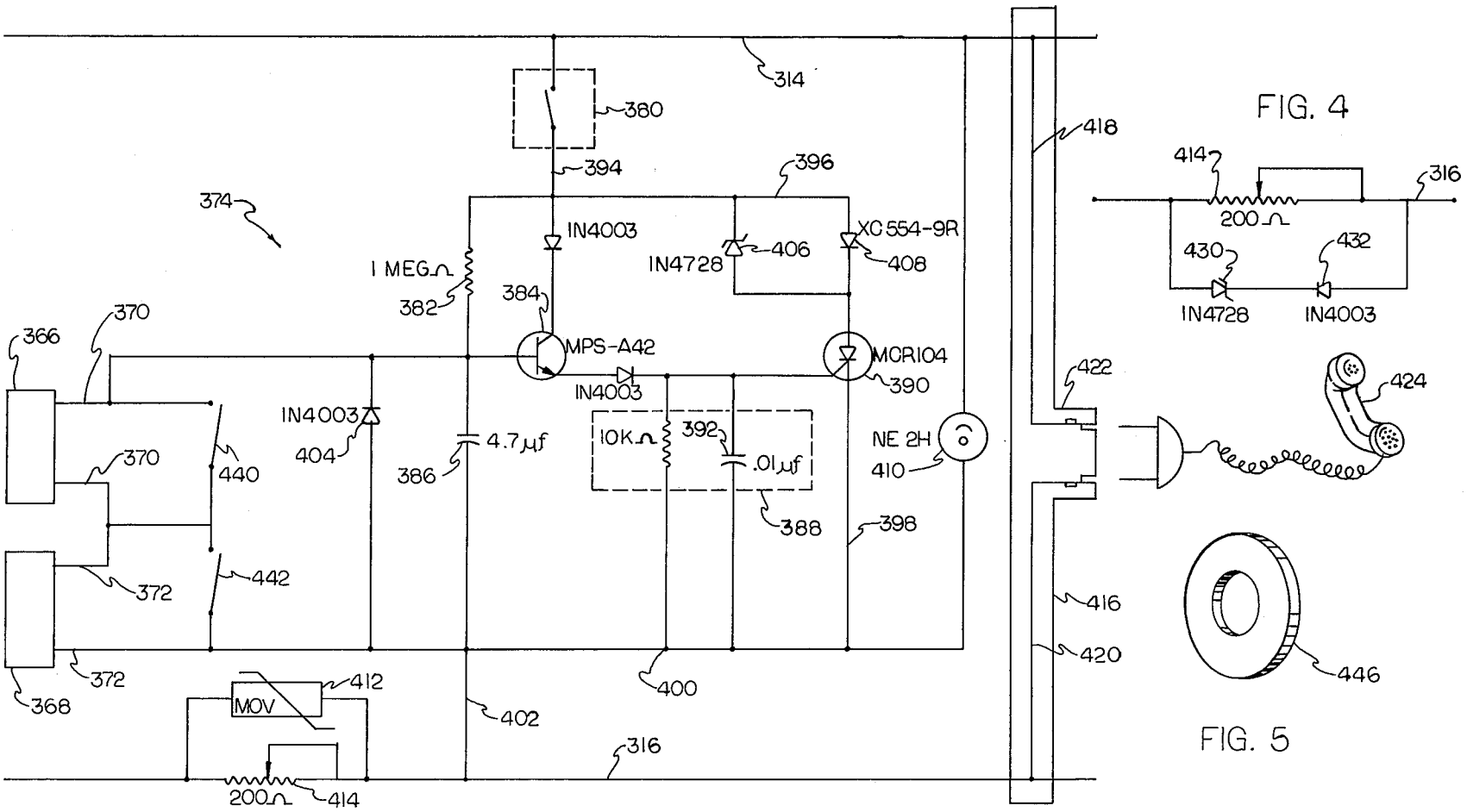
FIG. 3 is a circuit diagram of a tower module and sensors comprising detector means of the instant invention.
FIG. 4 is a circuit diagram of an alternate circuit for use as the detector reference resistance circuit of FIG. 3.
FIG. 5 is a perspective of a portable magnet for use with the bypass means of the detector means of FIG. 3.

Referring now to FIG. 3, a detector means is illustrated which includes sensors 366 and 368 conductively connected to a tower module 374 by conductors 370 and 372, respectively. The sensors 366, 368 may be any convenient device which is capable of detecting cable movement or displacement indicative of deroping. For the circuit illustrated in FIG. 3, the sensors 366, 368 are in effect conductive switches which become non-conductive upon operation in order to cause a conductive path through the other components which are otherwise non-conductive as more fully set forth below.

The tower module 374 circuitry as illustrated includes a normally closed reset switch 380, a blocking resistor 382, a transistor 384, a voltage capacitor 386, a filter 388 and a SCR 390. With a constant current signal present on the output supply line 316 and ground return line 314, and with the sensors 366, 368 in a conductive state, the blocking resistor 382 is sufficiently large in value to reflect an open circuit condition as to current flow while allowing the voltage capacitor 386 to charge. Upon detection of a derope condition, a sensor 366 (368) opens electrically placing a bias on the base of transistor 384 sufficient to cause it to fire. The transistor emitter current flows to charge the capacitor 392 of the filter 388 (to act as a delay and to filter out spurious signals). Thereafter, the emitter of the transistor 384, which is connected to the gate of the SCR 390, causes the triode 390 to fire and conduct current between the output 316 and ground lines 314 via conductors 394, 396, 398, 400 and 402. Once fired, the SCR 390 remains fired or conductive until current is removed from its anode. Accordingly, the circuit may be reset by interrupting current on the output supply line or by operating the reset switch 380 which is preferably a spring-loaded push button switch. The diode 404 provides a current path for the open circuit locate function discussed hereinafter. Zener diode 406, diode 408 and neon light 410 act as a surge suppressor circuit to protect circuit components from stray voltages which may be present on the output and ground lines 316, 314 from any cause including lightening. Similarly, the surge suppressor 412 acts to protect the detector electrical resistance 414 from stray voltages.

As here illustrated, the tower module 374 also includes an adapter 416 conductively connected to the output and ground lines 316, 314 by conductors 418 and 420. The conductors 418, 420 are connected to a connector 422 for removable conductive connection to communication means which as here illustrated is a telephone handset 424.

Each tower module 374 may be provided with an adapter 416. Further an adapter 416 may be connected proximate the output of the constant current generator 304 so that sound powered voice communication may be had between any one or more towers and the location of the constant current generator.

FIG. 4 illustrates an alternate circuit to protect the detector resistance 414 which may be used in lieu of the surge suppressor 412. The circuit is comprised of a zener diode 430 and a diode 432 having their anodes connected to the ground line at opposite sides of the resistance 414, and having their cathodes conductively connected.

As noted in FIG. 1, bypass means are associated with the detector to bypass the sensor means. For the tower module 374 of FIG. 3, the bypass means is comprised of a pair of magnetic leaf switches 440, 442 (normally open) which are conductively connected so that when closed they electrically short out their respective sensors 366, 368. The switches 440, 442 are positioned within the chassis 444 (FIG. 2) of the tower module 374 so that a permanent magnet can operate them (cause them to close) by placing the magnet against the chassis 444. The chassis 444 is preferably made of a magnetic material so that the permanent magnet may be magnetically held to the chassis 444 while simultaneously operating one of the leaf switches 440, 442. To control bypass operations, the magnets may be kept under lock and key, color coded and/or numbered in conformance with a preassigned tower module numbering. FIG. 5 depicts a magnet 446 which may be used to operate the magnetic leaf switches 440, 442. The magnet 446 is about one-fourth of a inch thick and about one and one-fourth to one and one-half inches in diameter. It is preferably constructed of a highly magnetized ferro magnetic material. In some circumstances, it may be preferable to fabricate the module chassis 444 from material such as aluminum. In that event, the chassis 444 may be provided with an aperture or slot into which the magnet 446 may be placed.

Figure 6:
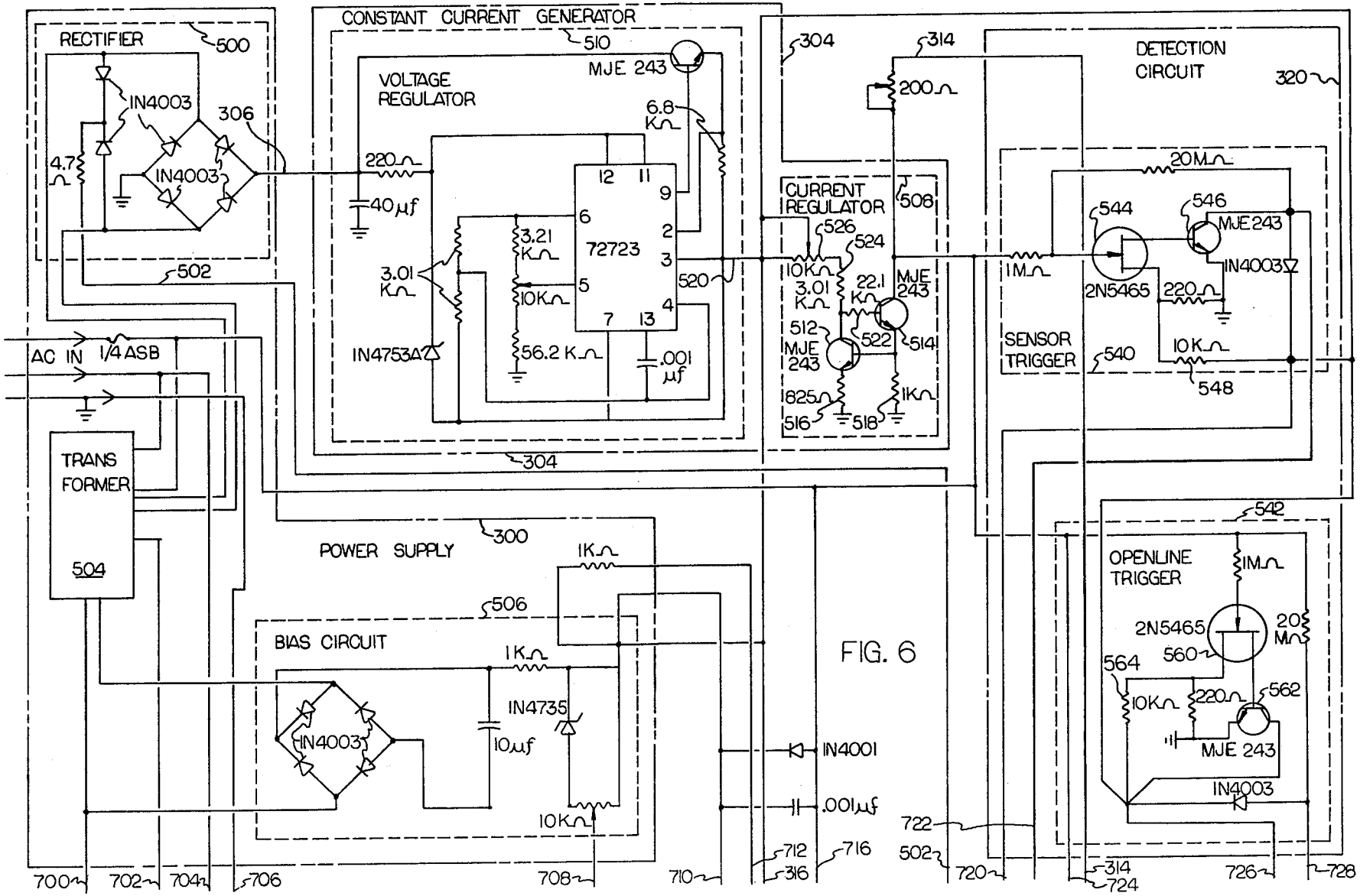
FIG. 6 is a practical circuit diagram of some of the components of the detector system of the instant invention.
Figure 7:
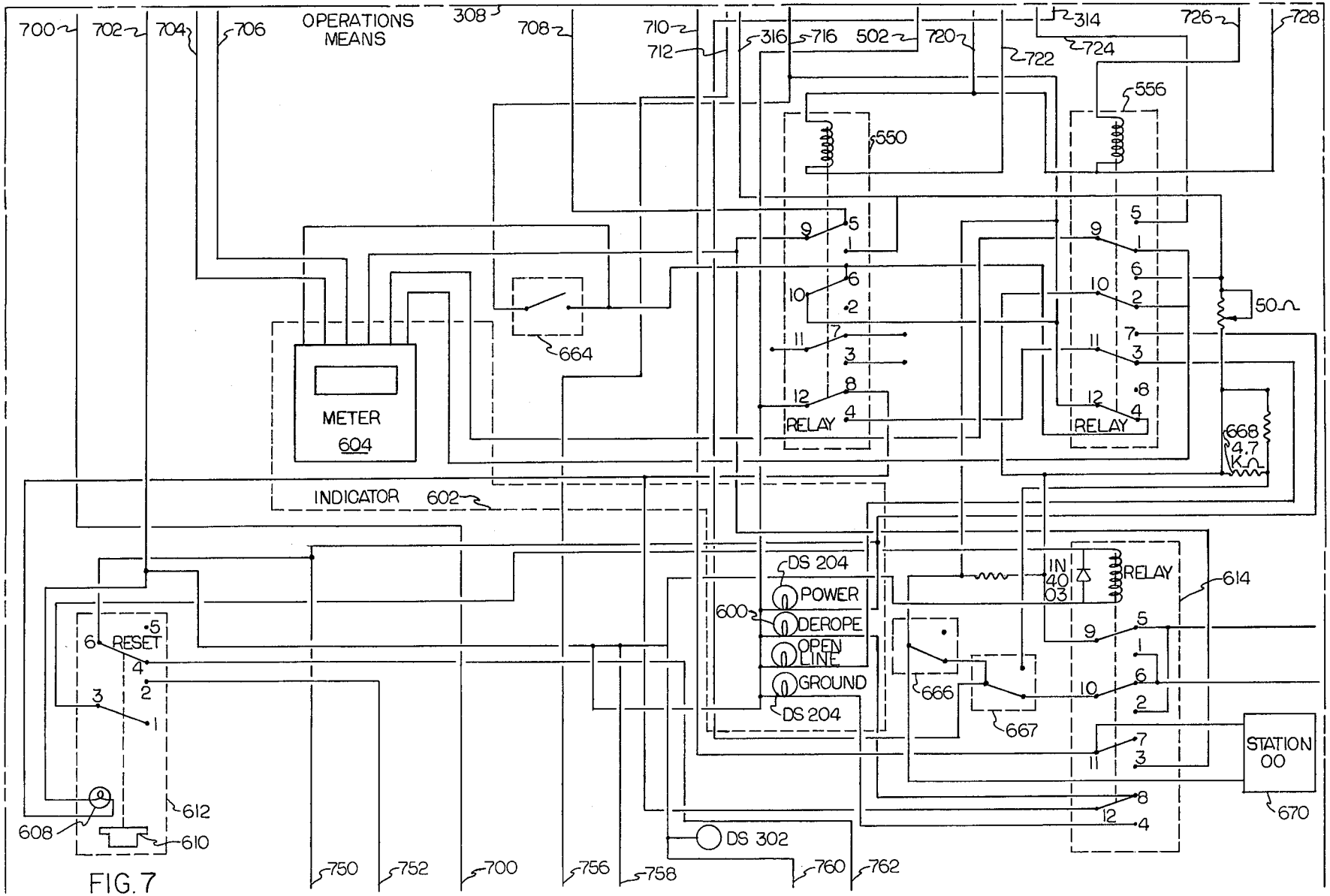
FIGS. 7 and 8 are together a practical circuit diagram of the operation means of the instant invention.
Figure 8:
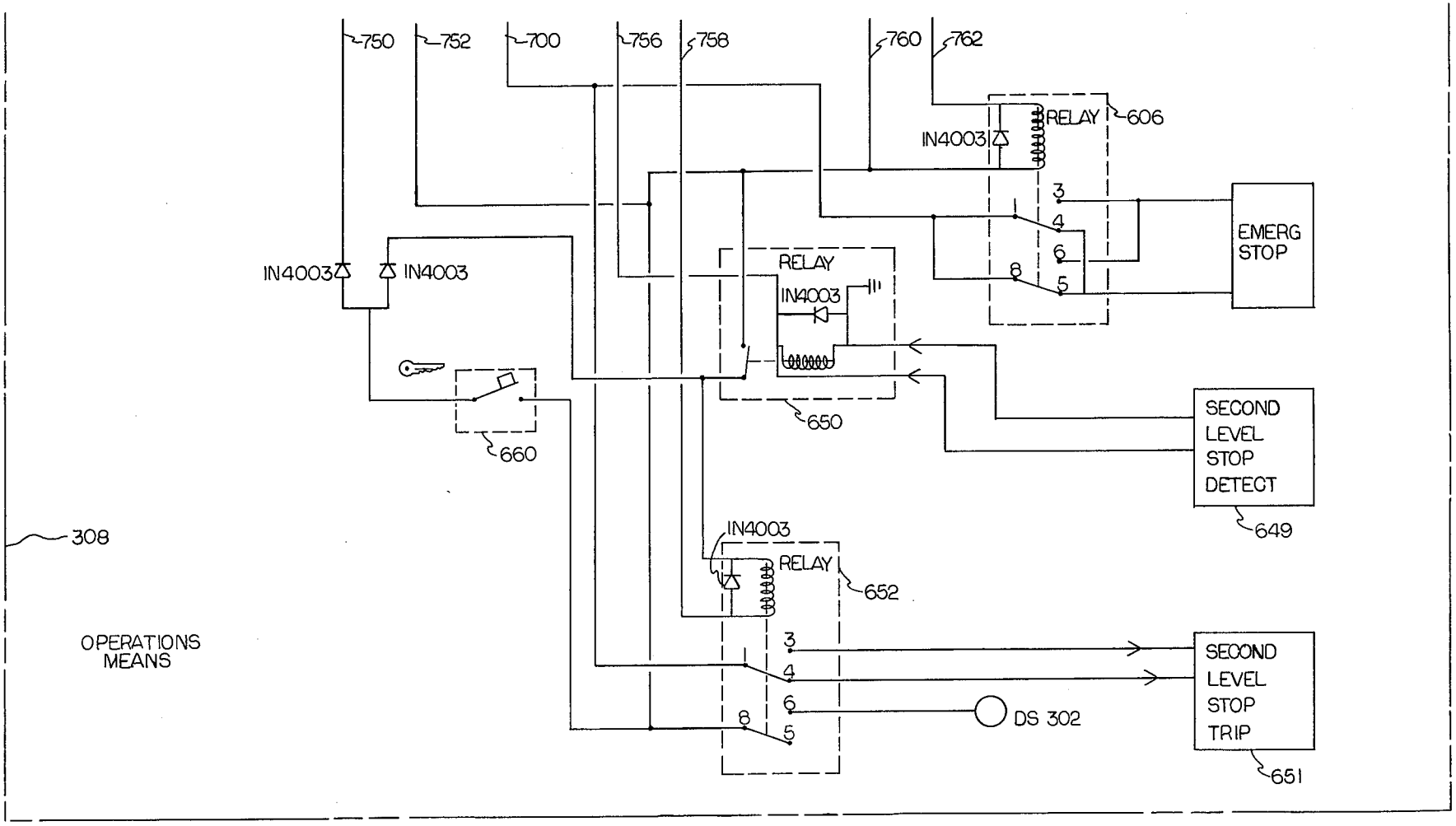

FIGS. 6, 7 and 8 illustrate practical circuitry of a highly preferred embodiment of the instant invention. FIG. 6 in particular illustrates a practical power supply 300, a highly preferred constant current generator 304, and a practical detection circuit 320. The power supply 300 is comprised of a rectifier circuit 500 to supply direct current power to the constant current generator 304 over conductor 306. The rectifier circuit 500 also supplies power to various components of the operation means 308 over conductor 502. The transformer 504 also supplies power to various components in the operations means. The bias voltage circuit 506 supplies a bias voltage to adjust the signal supplied to the meter indicating the location of a sensor operation.

The constant current generator 304 is comprised of a current regulator 508 and voltage regulator 510. The voltage regulator 510 supplies a regulated voltage input to the current regulator 508. The current regulator 508 is comprised of a first n-p-n transistor 512 and a second n-p-n transistor 514. The emitter of the first transistor 512 is connected to ground through a dropping resistor 516. The base of the first transistor 512 is also connected to ground via a dropping resistor 518. The base of the second transistor 514 is connected to the collector of the first transistor 512 via biasing resistor 522 and to the input 520 from the voltage regulator 510 via biasing resistors 522, 524 and 526. The emitter of the second transistor 514 is connected to the base of the first transistor 512; and the collector of the second transistor 514 is connected as the output of the constant current generator 304.

The circuit for the constant current generator 304 and in particular the current regulator 508, is highly preferred because it provides a constant current output unaffected by ambient temperature. That is, as the physical temperature of the second transistor 514 goes up, its gain increases and its emitter current increases. Similarly, as the physical temperature of the first transistor 512 increases its gain and emitter current increase. As the voltage across the dropping resistors 516 and 518 increase, the base bias voltage of the first transistor 512 increases; and the base bias voltage across bias resistors 522, 524 and 526 decreases. As a result, as the physical temperature of the first and second transistors 512, 514 change with ambient temperature, the bias voltages automatically adjust to maintain the output (collector) current of the second transistor 514 and in turn the output of the constant current generator 304 constant or unaffected by ambient conditions.

FIG. 6 also depicts the detection circuit 320 which is comprised of a sensor trigger 540 and an open line trigger 542. The sensor trigger 540 is comprised of a unijunction 544 and a transistor 546 with a hysteresis resistor 548 to provide for snap action of the sensor relay 550 in the operation means 308 (see FIG. 7). The open line trigger 542 also includes a unijunction 560 and transistor 562 with a hysteresis resistor 564 to provide for snap action of the open line relay 566 in the operation means 308 (see FIG. 7).

The operation means 308 is best illustrated in FIGS. 7 and 8. The interconnection of the components of FIG. 6 with those of FIG. 7 is effected by conductors 314, 316, 502, 700, 702, 704, 706, 708, 710, 712, 716, 720, 722, 724, 726 and 728. The interconnection of components of FIG. 7 with those of FIG. 8 is effected by conductors 700, 750, 752, 756, 758, 760 and 762.

The operation means 308 of FIGS. 7 and 8 include the sensor relay 550 which is normally energized. When a sensor 366, 368 (FIG. 3) operates and the sensor trigger 540 detects the change in voltage across the output of the constant current generator 304, the sensor trigger 540 actuates the sensor relay 550 and causes it to de-energize. The resulting change in relay contact position causes the derope light 600 of the indicator means 602 to be illuminated and for the meter 604 of the indicator means 602 to be connected across the output of the constant current generator 304 so that the predictable voltage thereacross can be reflected in a visual numerical readout on the meter 604 which is preselected to reflect the identity of the tower module 374 (FIG. 2) or detector 312 (FIG. 1) associated with the operating sensor 334 (FIG. 1). That is, the voltage at the output of the constant current generator 304 will reflect the sum of the voltage drops across each detector resistance 336 (FIG. 1) (414, FIG. 3) in circuit up to and including that of the detector 312 with the operating sensor 334, but not including the resistances 336 of the detectors 312 subsequent in electrical circuit including the reference resistance 332. At the same time, the emergency stop relay 606, which is normally energized, is de-energized to cause external emergency stops (e.g., a relay) to remove power and stop the personnel cable transport system (e.g., ski chair lift). At the same time, the light 608 located in and behind the translucent push buttom 610 of the reset switch 612 is illuminated. Preferably, a legend will be present on the button instructing the operator to push to reset. Pressing the reset button 610 (operating the switch 612) energizes the open circuit locate relay 614 interrupting the power supplied to the SCR 390 (FIG. 3) of the activated detector means. Interrupting the power allows the triode 390 to de-energize and reset. Assuming the stimulus that caused a detector to operate is no longer present, the voltage at the output of the constant current generator 304 will return to its predicted normal position allowing the trigger 540 to reactivate the sensor relay 550.

The open line relay 556 functions similar to the sensor relay 550. The open line relay 556 is normally energized upon the occurrence of an open line (circuit) condition in the output supply line 316 or ground return line 314. The open line trigger 542 senses the voltage change across the output of the constant current generator 304 and de-energizes the open line relay 556. As a result, the light 608 of the reset button 610 is energized. The emergency stop relay 606 is de-energized, and the open line light 616 of the indicator means 602 is energized. Upon activating the reset switch 612, the open line locate relay 614 is energized electrically reversing or interchanging the ground return line 316 and supply line 314. That is, the ground return line 316 is converted to an alternate output supply line; and the output supply line 314 is converted into an alternate ground return line. Upon reversing the lines, the output of the constant current generator 304 is supplied to the detectors. As best seen in FIG. 3, a small current (for the circuits herein illustrated, about 52 micro-amperes) passes through the diode 404 and resistor 382. With an open line (circuit condition), the total current flow will be a multiple of the number of detectors passing the small current. If detectors are numbered sequentially from the closest to the constant current generator 304 to the farthest as 1, 2, 3 through *n*, and with a current flow of, for example, 104 (52 × 2) micro-amperes, then the open circuit condition should exist between the second and third detector means. The total current flow is translated into a visual numerical readout by the meter 604 of the indicator means indicating the identity of tower 2 as the last tower module 397 in sequence which is conducting current.

When the detector system of the instant invention is used with a personnel cable transport system, it may be desirable to provide for detection of other malfunctions of hazardous conditions in addition to the derope condition. Such conditions may be less critical and may be regarded as secondary in character. For example, excessive movement of the counterbalance weight 620 (FIG. 2) which is suspended by a cable 621 from a wheel 622 in a track 623 may reflect a cable 352 malfunction. A trip, a switch or other detector can detect the excessive movement to cause a shutdown. Other conditions may also suggest the need for a shutdown depending on the particular installation. The signals calling for a shutdown (secondary stops) are supplied by second level stop detectors 649 to a secondary stop relay 650 which is normally energized (see FIG. 8). The second level stop detectors 649 may be detectors of the type described and illustrated in FIGS. 1 and 3 or other types such as proximity switches or micro-switches. Upon detection of a secondary stop condition, the secondary stop relay 650 de-energizes which causes the secondary shutdown relay 652 to de-energize and stop chair lift system operation preferably through operation of a second level stop trip device 651 which may be a relay or coil operated contacts.

The following tables reflect relay contact positions.

TABLE I

| X = closed | O = open | | | | N = normal condition | | | |
|---|---|---|---|---|---|---|---|---|
| | 1–9 | 5–9 | 2–10 | 6–10 | 3–11 | 7–11 | 4–12 | 8–12 |
| SENSOR RELAY (550) | | | | | | | | |
| (N) energized | X | O | X | O | X | O | X | O |
| de-energized | O | X | O | X | O | X | O | X |
| OPEN LINE RELAY (556) | | | | | | | | |
| (N) energized | O | X | O | X | O | X | O | X |
| de-energized | X | O | X | O | X | O | X | O |
| OPEN LINE LOCATE RELAY (614) | | | | | | | | |
| energized | O | X | O | X | O | X | O | X |
| (N) de-energized | X | O | X | O | X | O | X | O |

TABLE II

| X = closed contacts | O = open | | N = normal condition | | |
|---|---|---|---|---|---|
| | 4–1 | 3–1 | 5–8 | 6–8 | 8–14 |
| EMERGENCY Shutdown Relay (606) | | | | | |
| (N) energized | X | O | X | O | — |
| de-energized | 0 | X | O | X | — |
| SECONDARY STOP (650) | | | | | |
| (N) energized | — | — | — | — | X |
| de-energized | — | — | — | — | O |
| SECONDARY SHUTDOWN (652) | | | | | |
| (N) energized | X | O | X | O | — |
| de-energized | O | X | O | X | — |

The operation means 308 also includes a key bypass switch 660. That is, the switch 660 when activated (normally open, actuate to close) provides power to electrically energize the secondary shutdown relay 652 and the emergency shutdown relay 606. In providing such power, all the detection means and secondary stops are bypassed because their operation will not actuate their respective shutdown relays. The switch 660 is preferably operated with a key which may be securely retained to avoid unauthorized use (see FIG. 8). On-off switch 664 is provided to turn power on and off to the meter 604 of the indicator means 602. The calibrate switches 666 and 667 allow for calibration of the indicator 602 with the calibration resistor 668 (see FIG. 7).

The station 00 input 670 is provided to supply a reference signal for malfunctions which may occur within the operation means 308. That is, a malfunction may occur in the circuitry of the operation means 308 to cause a change in the voltage at the output of the constant current generator 304 to in turn cause the triggers 540, 542 to operate and shut down the system. The station 00 input 670 provides a reference signal so that the meter will reflect the location 00 as the location of the malfunction.

It is to be understood that the embodiments of the invention herein illustrated and described are merely illustrative of the principles of the invention. Reference herein to details of the illustrated embodiments is not intended to limit the scope of the claims which themselves recite those features regarded as essential to the invention.

I claim:

1. Detection apparatus comprising:

a power supply;

a constant current generator conductively connected to said power supply to receive electrical energy therefrom and having an output for supplying constant current electrical energy;

an output line conductively connected to said output of said constant current generator;

a ground line conductively connected to said constant current generator;

a plurality of detector means each conductively connected to said output line and said ground line, each of said detector means including:

a detector electrical resistance connected in series circuit in said output line, sensor means conductively connected between said output line and said ground line, said sensor means being electrically nonconductive in the absence of external stimulus and becoming electrically conductive upon the incidence of external stimulus, and bypass means which operates to bypass said sensor means, said bypass means including means cooperatively associated therewith to indicate that a sensor means is bypassed;

a reference electrical resistance conductively connected between said output line and said ground return line;

a detector circuit conductively connected to said output of said constant current generator and said ground line to detect the electrical voltage present at said output of said constant current generator and to generate a detection signal reflective of said voltage;

operation means conductively connected to receive said detection signal and operate in relation thereto; and wherein said constant current generator supplies a constant electrical current at its output to said detector means and said reference electrical resistance resulting in the presence of a predictable voltage at the output of said constant current generator reflective of the total electrical resistance in the circuit of said output and said ground line so that upon the incidence of external stimulus the resulting electrical conduction of a sensor means causes a change in the total electrical resistance in circuit and a predictable change in the voltage at said output that is detected by said detector circuit which thereupon generates a detection signal that activates said operation means.

2. The apparatus of claim 1 wherein said bypass means is comprised of a magnetically controlled switch and a portable magnet, said magnet being remotely stored and being portable to the location of said detector means and positionable proximate said magnetically controlled switch to cause said switch to operate.

3. The apparatus of claim 2 wherein said detector means further includes a chassis, said magnetically controlled switch which is positioned therewithin to be operable by said magnet by positioning said maget against said chassis proximate said switch, said magnet being sized to be hand held and positionable on said chassis.

4. The apparatus of claim 1 wherein said constant current generator is comprised of:

a voltage regulator conductively connected to receive power from said power supply and supply a regulated voltage as its output;

a current regulator conductively connected to receive the output of said voltage regulator and to supply a constant current as the output of said constant current generator, said current regulator being comprised of:

a first n-p-n transistor having a base, an emitter and a collector, said base being conductively connected to ground through a first dropping resistance and said emitter being conductively connected to ground through a second dropping resistance, a second n-p-n transistor having a base, an emitter and a collector, said emitter being conductively connected to the base of said first transistor, said collector being conductively connected as the output of said constant current generator, and said base being conductively connected to receive the output of said voltage regulator through a first biasing resistance and to the collector of said first transistor through a second biasing resistance.

5. The apparatus of claim 1 further comprising a plurality of adapter means conductively connected to said output and ground return lines and a plurality of communications means removably conductively connectable to said adapter means so that when conductively connected, communications may be had among and between said communication means.

6. The apparatus of claim 5 wherein one of said adaptor means is positioned proximate said constant current generator and other adapter means are positioned proximate each of said detector means.

7. The apparatus of claim 6 wherein said communication means are telephone handsets.

8. The apparatus of claim 1 wherein said detector circuit includes:

an open-line detection trigger to detect the existance of a predictable voltage at the output of said constant current generator reflecting the absence of a completed circuit conducting current between said output line and said ground return line; and a sensor trigger to detect the existance of a predictable voltage at the output of said constant current generator reflecting the incidence of said external stimulus and sensor means conduction.

9. The apparatus of claim 8, including open-circuit locating means conductively connected in said output line and said ground line operable to electrically convert said output line into an alternate ground return line and said ground line into an alternate output supply line, and wherein said constant current generator includes a voltage regulator conductively connected to a dropping resistor which is conductively connectable to said alternate output supply line, and wherein each said detector means includes circuit means which permits the flow of electrical current from said alternate output supply line to said alternate ground return line and which inhibits the flow of electrical current from said output line to said ground line so that upon the operation of said open-circuit locating means current flows from said alternate output supply line to said alternate ground return line so that a predictable voltage is generated across said dropping resistor reflective of the total electrical current in circuit and in turn the identity of the detector means farthest in electrical circuit from the output of said constant current generator through which electrical current passes and in turn the location of the detector means nearest an open-circuit condition in said output and ground line and said detection circuit detects said predictable voltage and generates a detection signal reflecting said voltage which is received by said operation means and in turn said indicator means to display the identity of said identified detector means.

10. The apparatus of claim 9 wherein said operation means includes:

indicator means which receives said detection signals to visually display the identity of an electrically conductive sensor means and, in the presence of an open-circuit condition in said output and ground return lines, the identity of that detector means subsequent in electrical circuit to which said open circuit condition exists;

reset means to be manually operated to cause reactivation of said apparatus subsequent to the generation of a detection signal by said detection means; and manual bypass means to be manually operated to electrically bypass all detection signals.

11. The apparatus of claim 10 wherein each of said detector means further includes:

reset means to reactivate the detector means subsequent to its actuation of said sensor means by said external stimulus; and delay means conductively connected to prevent spurious actuation of said apparatus.

12. The apparatus of claim 11 wherein said sensor means is connected to said output supply line subsequent in electrical circuit to said detector electrical resistance and said reference resistor is connected subsequent in electrical circuit to said detector means.

13. Detection apparatus for use with a personnel cable transport system having a plurality of cable support towers each of which has grooved rotatable cable wheels to support said cable while permitting cable movement, said apparatus comprising:

a power supply;

a constant current generator conductively connected to said power supply to receive electrical energy therefrom and having an output for supplying constant current electrical energy;

an output line conductively connected to said output of said constant current generator;

a ground line conductively connected to said constant current generator;

a plurality of detector means each positioned proximate said cable and cable wheels and conductively connected between said output line and said ground line each of said detector means including:

a detector electrical resistance connected in series circuit in said output line; and sensor means conductively connected to said output line and said ground line, said connection to said output line being subsequent in electrical circuit to said resistor, said sensor means being positioned proximate both said wheels and said cable and said sensor means being non-conductive when said cable is positioned in the groove of said wheels and becoming electrically conductive upon the deroping of said cable, and bypass means which operates to bypass said sensor means, said bypass means including means cooperatively associated therewith to indicate that a sensor means is bypassed;

a reference electrical resistance conductively connected between said output line and said ground return line subsequent in electrical circuit to said detector means;

a detector circuit conductively connected to said output of said constant current generator and said ground line to detect the electrical voltage at the output of said constant current generator and to generate detection signals reflective of said voltage;

indicator means conductively connected to said power supply to receive electrical power therefrom and to said detector means to receive said detection signals to indicate the existance of said deroping;

operation means connected to said detector circuit to receive said detection signals and send a stop signal to stop said personnel cable transport system upon the occurrence of said deroping; and wherein said constant current generator supplies a constant electrical current at its output to said detector means and said reference electrical resistance resulting in the presence of a predictable voltage at the output of said constant current generator reflective of the total electrical resistance in said circuit of output line and said ground line so that upon the occurrence of a deroping of said cable the resulting electrical conduction of a sensor means causes a change in the total electrical resistance in circuit and a predictable change in the voltage at said output of said constant current generator indicative of the location of the detector means detecting said derope condition, said detector circuit detecting said predictable voltage change and transmitting said detection signals reflective of said change to said indicator means to indicate the presence and location of said derope condition and to said operation means to stop said personnel cable transport system.

14. The apparatus of claim 13 wherein said bypass means is comprised of a magnetically controlled switch and a portable magnet, said magnet being remotely stored portable to the location of said detector means and positionable proximate said magnetically controlled switch to cause said switch to operate.

15. The apparatus of claim 14 wherein said detector means further includes a chassis containing said magnetically controlled switch which is positioned therewithin to be operable by said magnet by positioning said magnet against said chassis proximate said switch, said magent being sized to be hand held and positionable on said chassis.

16. The apparatus of claim 15 wherein said constant current generator is comprised of:

a voltage regulator conductively connected to receive power from said power supply and supply a regulated voltage as its output;

a current regulator conductively connected to receive the output of said voltage regulator and to supply a constant current as the output of said constant current generator, said current regulator being comprised of:

a first n-p-n transistor having a base, an emitter and a collector, said base being conductively connected to ground through a first dropping resistance and said emitter being conductively connected to ground through a second dropping resistance, a second n-p-n transistor having a base, an emitter and a collector, said emitter being conductively connected to the base of said first transistor, said collector being conductively connected as the output of said constant current generator, and said base being conductively connected to receive the output of said voltage regulator through a first biasing resistance and to the collector of said first transistor through a second biasing resistance.

17. The apparatus of claim 13 further comprising a plurality of adapter means conductively connected to said output and ground return lines and a plurality of communications means removably conductively connectable to said adapter means so that when conductively connected, communications may be had among and between said communication means.

18. The apparatus of claim 17 wherein one of said adapter means is positioned proximate said constant current generator and other adapter means are positioned proximate each of said detector means.

19. The apparatus of claim 18 wherein said communication means are telephone handsets.

20. The apparatus of claim 13 wherein said detector circuit includes:

an open-line detection trigger to detect the existance of a predictable voltage at the output of said constant current generator reflecting the absence of a completed circuit conducting current between said output line and said ground return line; and a sensor trigger to detect the existance of a predictable voltage at the output of said constant current generator reflecting the incidence of said external stimulus and sensor means conduction.

21. The apparatus of claim 20, including open-circuit locating means conductively connected in said output line and said ground line operable to electrically convert said output line into an alternate ground return line and said ground line into an alternate output supply line, and wherein said constant current generator includes a voltage regulator conductively connected to a dropping resistor which is conductively connectable to said alternate output supply line, and wherein each said detector means includes circuit means which permits the flow of electrical current from said alternate output supply line to said alternate ground return line and which inhibits the flow of electrical current from said output line to said ground line so that upon the operation of said open-circuit locating means current flows from said alternate output supply line to said alternate ground return line so that a predictable voltage is generated across said dropping resistor reflective of the total electrical current in circuit and in turn the identity of the detector means farthest in electrical circuit from the output of said constant current generator through which electrical current passes and in turn the location of the detector means nearest an open-circuit condition in said output and ground line and said detection circuit detects said predictable voltage and generates a detection signal reflecting said voltage which is received by said operation means and in turn said indicator means to display the identity of said identified detector means.

22. The apparatus of claim 21 wherein said operation means includes:

indicator means which receives said detection signals to visually display the identity of an electrically conductive sensor means and in the presence of an open-circuit condition in said output and ground return lines, the identity of that detector means subsequent in electrical circuit to which said open circuit condition exists;

reset means to be manually operated to cause reactivation of said apparatus subsequent to the generation of a detection signal by said detection means; and manual bypass means to be manually operated to electrically bypass all detection signals.

23. The apparatus of claim 22 wherein each of said detector means further includes:

reset means to reactivate the detector means subsequent to its actuation of said sensor means by said external stimulus; and delay means conductively connected to prevent spurious actuation of said apparatus.

24. The apparatus of claim 23 wherein said detector means is connected to said output supply line subsequent in electrical circuit to said detector electrical resistance and said reference resistor is connected subsequent in electrical circuit to said detector means.

* * * * *